US007875816B2

(12) United States Patent
Yoon et al.

(10) Patent No.: US 7,875,816 B2
(45) Date of Patent: Jan. 25, 2011

(54) CONTROL PANEL ASSEMBLY FOR LAUNDRY DEVICE

(75) Inventors: Ju Han Yoon, Changwon-si (KR); Sung Gi Hwang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 94 days.

(21) Appl. No.: 12/097,787

(22) PCT Filed: Dec. 27, 2006

(86) PCT No.: PCT/KR2006/005749

§ 371 (c)(1),
(2), (4) Date: Sep. 24, 2008

(87) PCT Pub. No.: WO2007/075038

PCT Pub. Date: Jul. 5, 2007

(65) Prior Publication Data

US 2009/0139847 A1 Jun. 4, 2009

(30) Foreign Application Priority Data

Dec. 29, 2005 (KR) ..... 10-2005-0134136
Dec. 29, 2005 (KR) ..... 10-2005-0134137
Dec. 29, 2005 (KR) ..... 10-2005-0134138

(51) Int. Cl.
*H01H 9/26* (2006.01)

(52) U.S. Cl. ..... 200/5 A

(58) Field of Classification Search ..... 200/5 A, 200/296, 345

See application file for complete search history.

(56) References Cited

U.S. PATENT DOCUMENTS

| | | | | |
|---|---|---|---|---|
| 4,418,398 | A | 11/1983 | Hornung | 364/900 |
| 4,510,778 | A * | 4/1985 | Cotton | 68/12.15 |
| 5,432,684 | A | 7/1995 | Fye et al. | 362/30 |
| 5,834,745 | A * | 11/1998 | Aoki et al. | 219/720 |
| 2002/0021562 | A1 | 2/2002 | Tholin et al. | 362/29 |

FOREIGN PATENT DOCUMENTS

| | | | |
|---|---|---|---|
| CN | 1592014 | A | 3/2005 |
| DE | 198 14 446 | A1 | 10/1999 |
| EP | 0 615 264 | B1 | 9/1994 |
| EP | 1 176 619 | A2 | 1/2002 |
| EP | 1 179 828 | A1 | 2/2002 |
| EP | 1 179 828 | B1 | 2/2002 |
| EP | 1 511 050 | A2 | 3/2005 |
| WO | WO 99/50809 | A2 | 10/1999 |

OTHER PUBLICATIONS

Chinese Office Action dated Apr. 26, 2010 for Application No. 200680049299.3.
International Search Report dated Apr. 18, 2007.
European Search Report dated Jul. 1, 2009.

* cited by examiner

*Primary Examiner*—Edwin A. Leon
*Assistant Examiner*—Vanessa Girardi
(74) *Attorney, Agent, or Firm*—KED & Associates, LLP

(57) ABSTRACT

A control panel assembly of a laundry device is disclosed, by which a manipulation of buttons (200) is facilitated by improving button configurations of the laundry device. The present invention includes a control panel (100) provided to a front side of a body and a keypad provided to the control panel, the keypad (200) having a plurality of button groups (200*a*, 200*b*, 200*c*, 200*d*) enabling a washing to be performed by selecting a plurality of operational conditions once.

20 Claims, 13 Drawing Sheets

[Fig. 1]
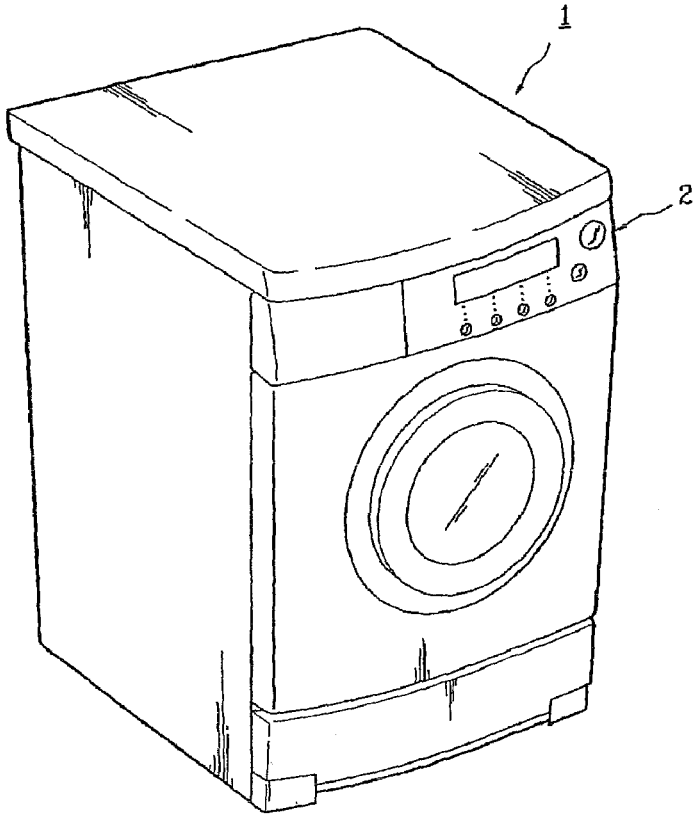
[Fig. 2]
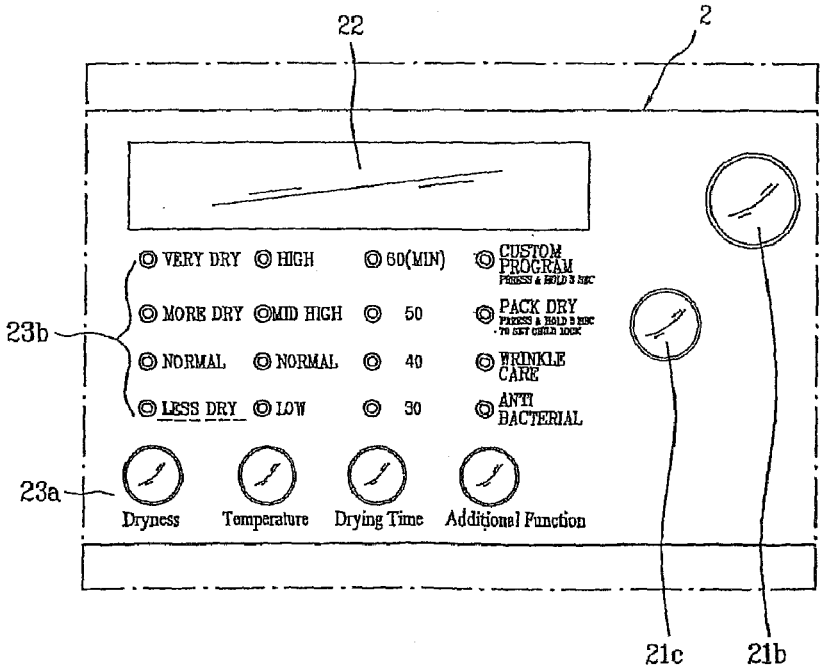

[Fig. 3]
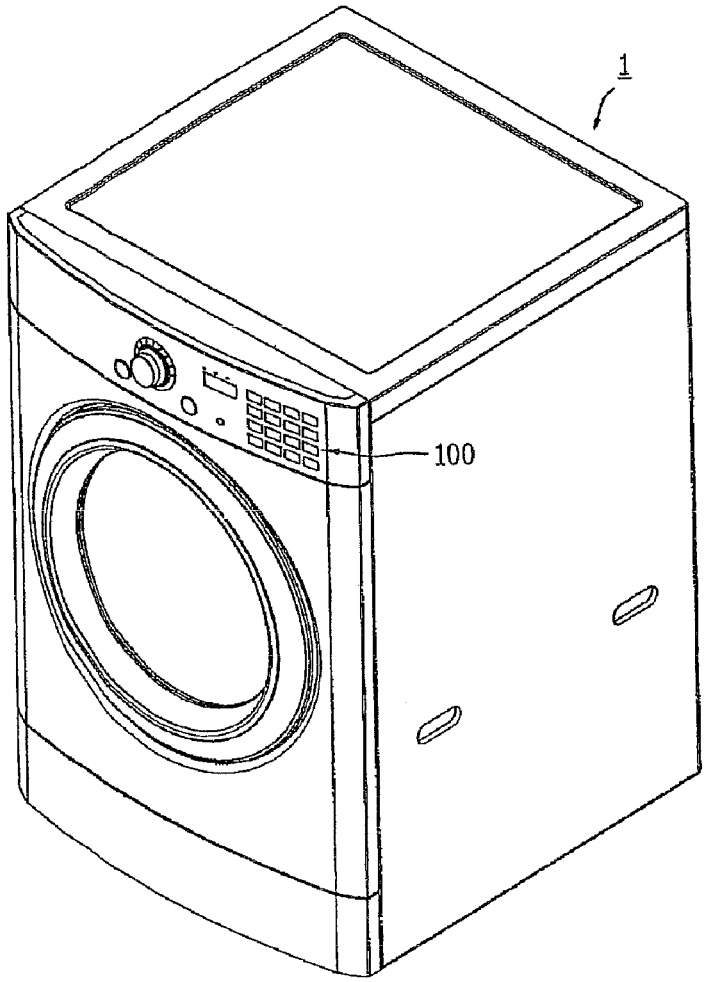

[Fig. 4]
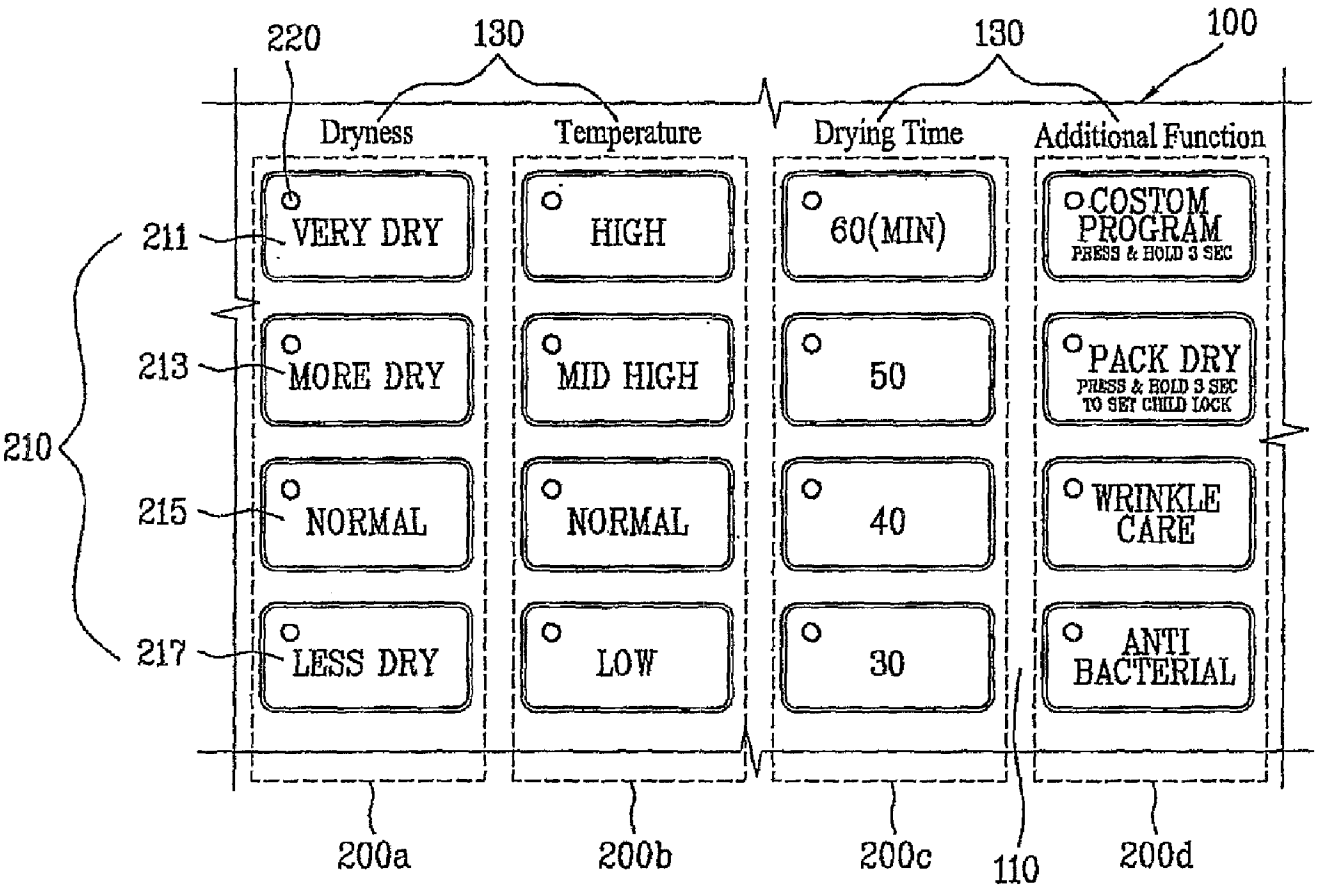

[Fig. 5]
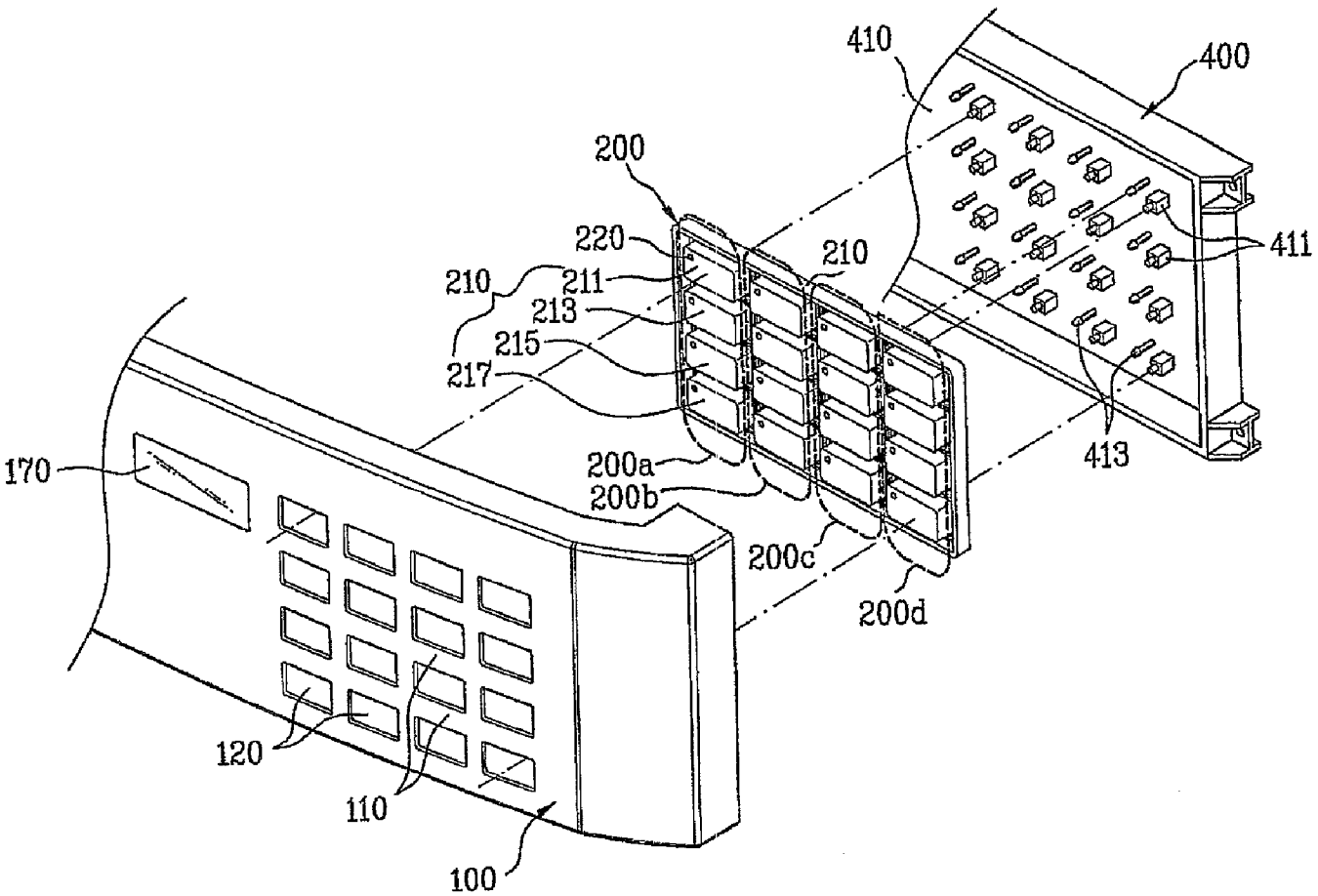

[Fig. 6]
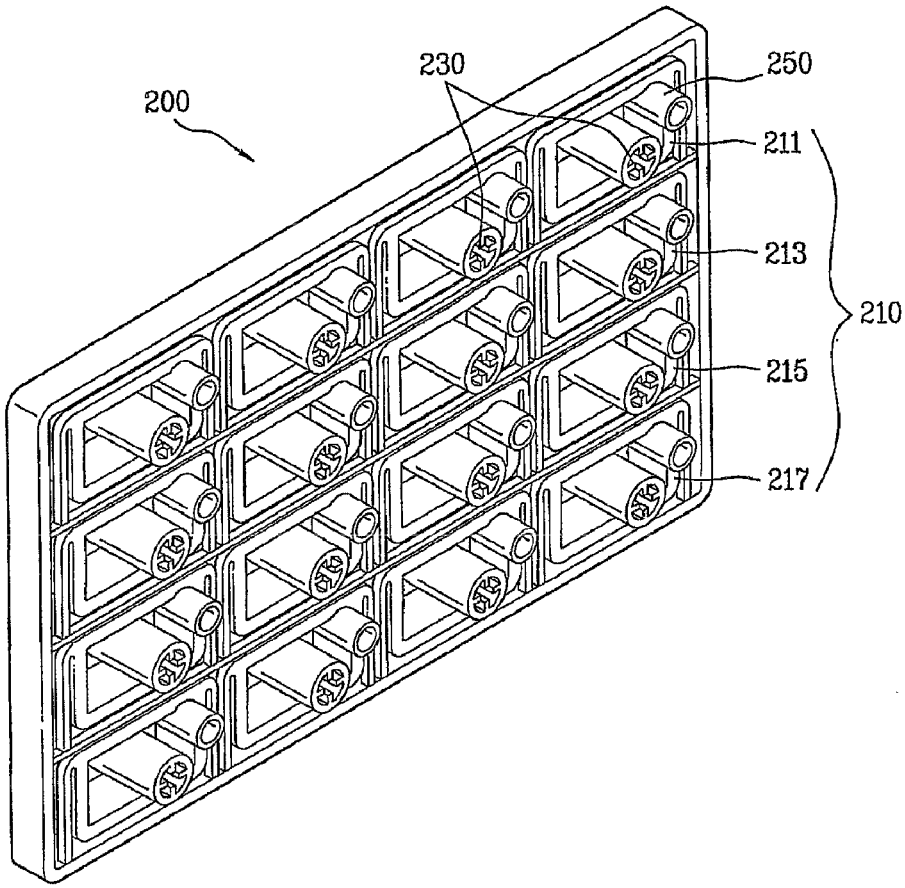

[Fig. 7]
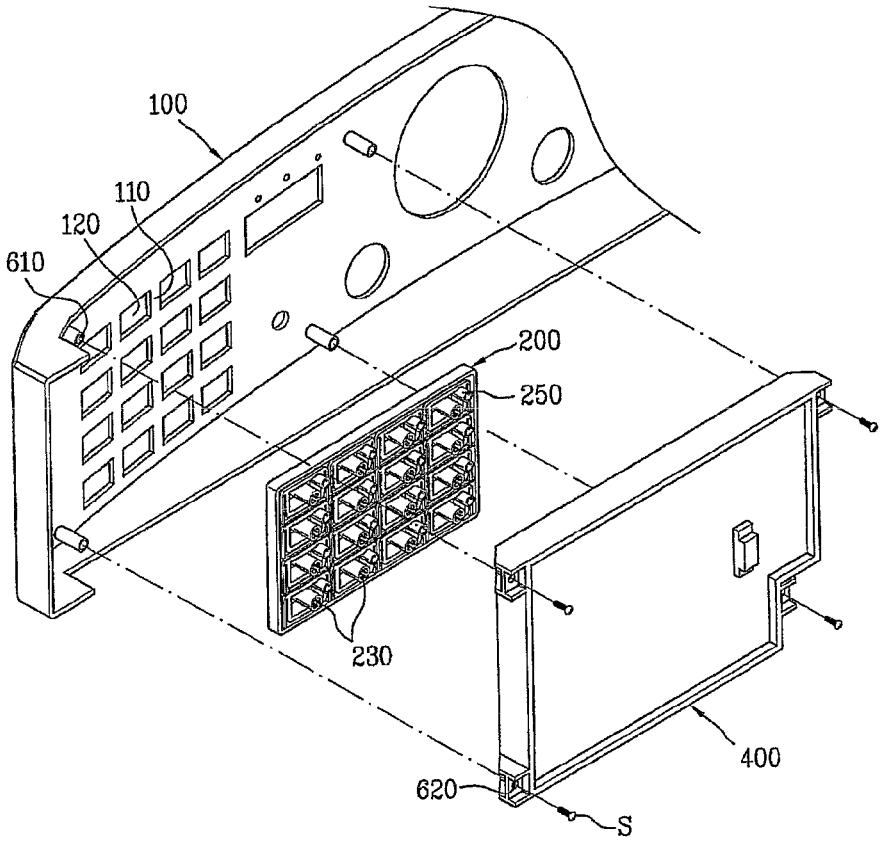

[Fig. 8]
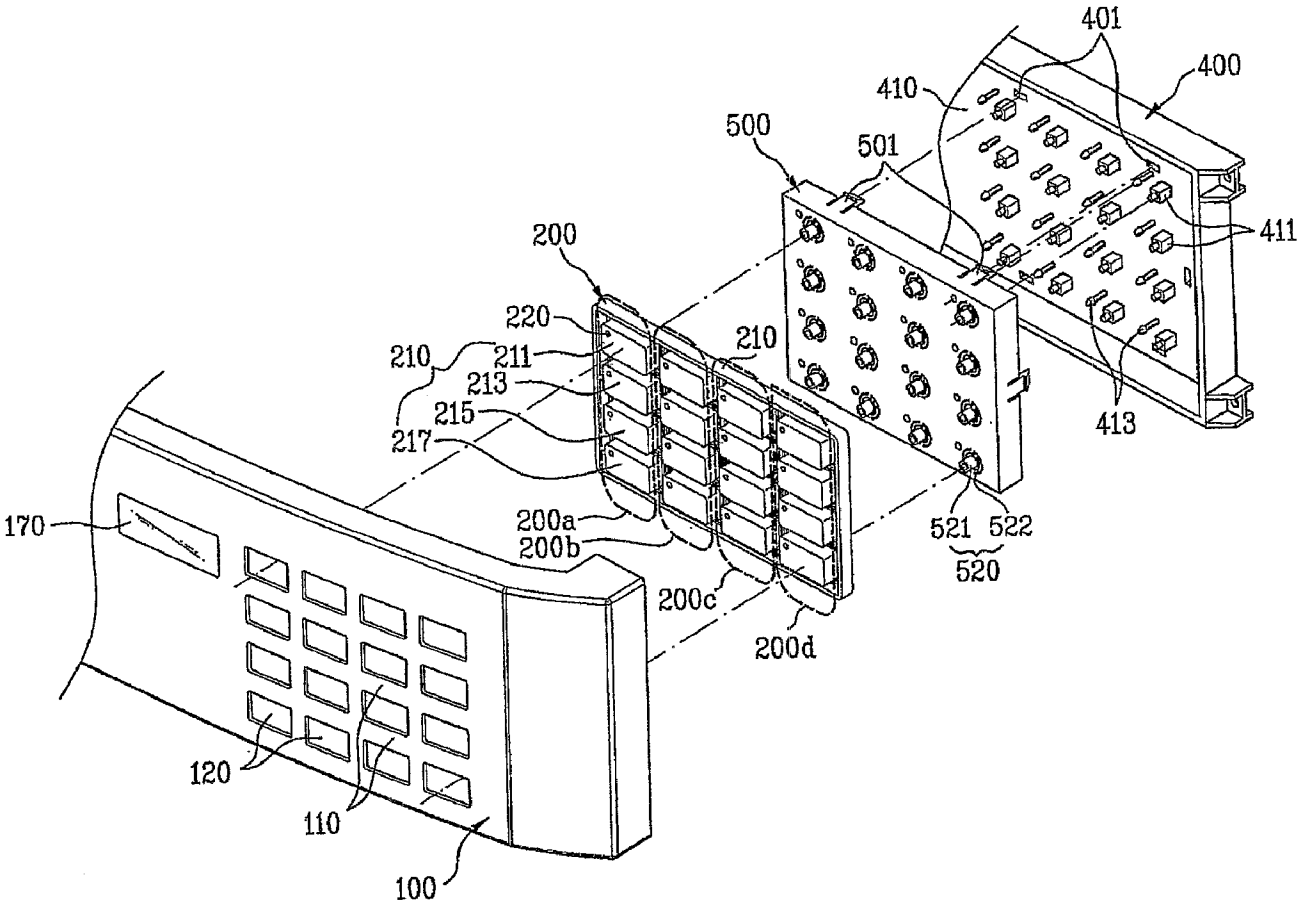

[Fig. 9]
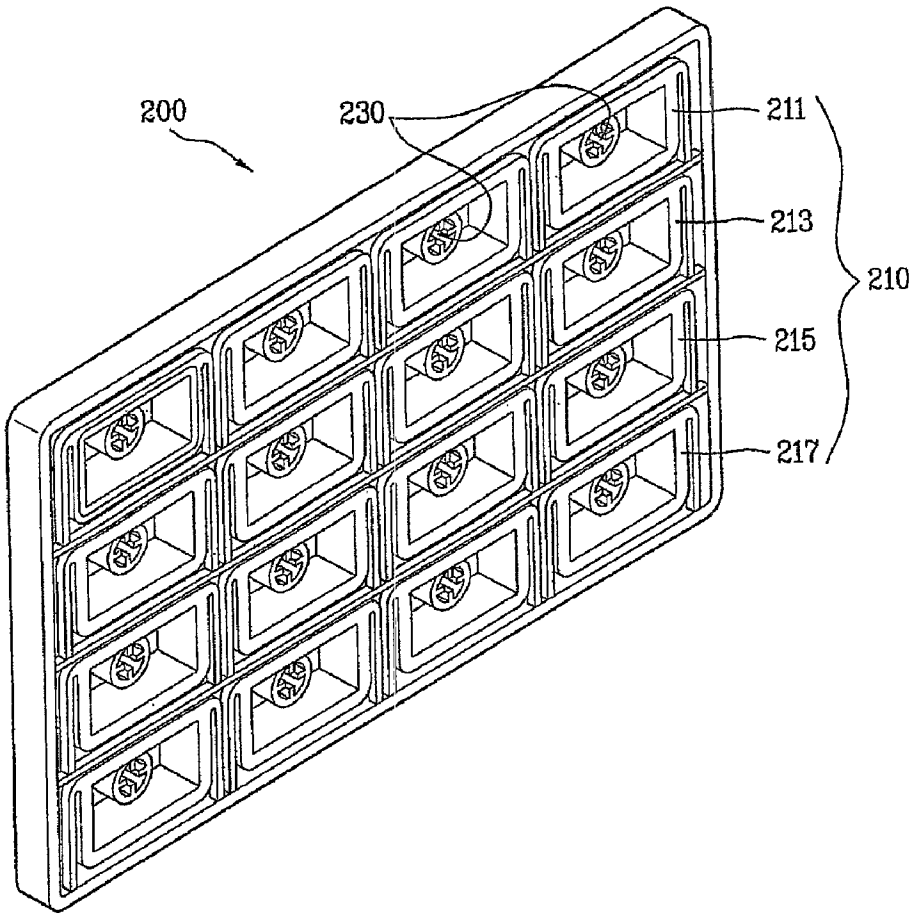

[Fig. 10]
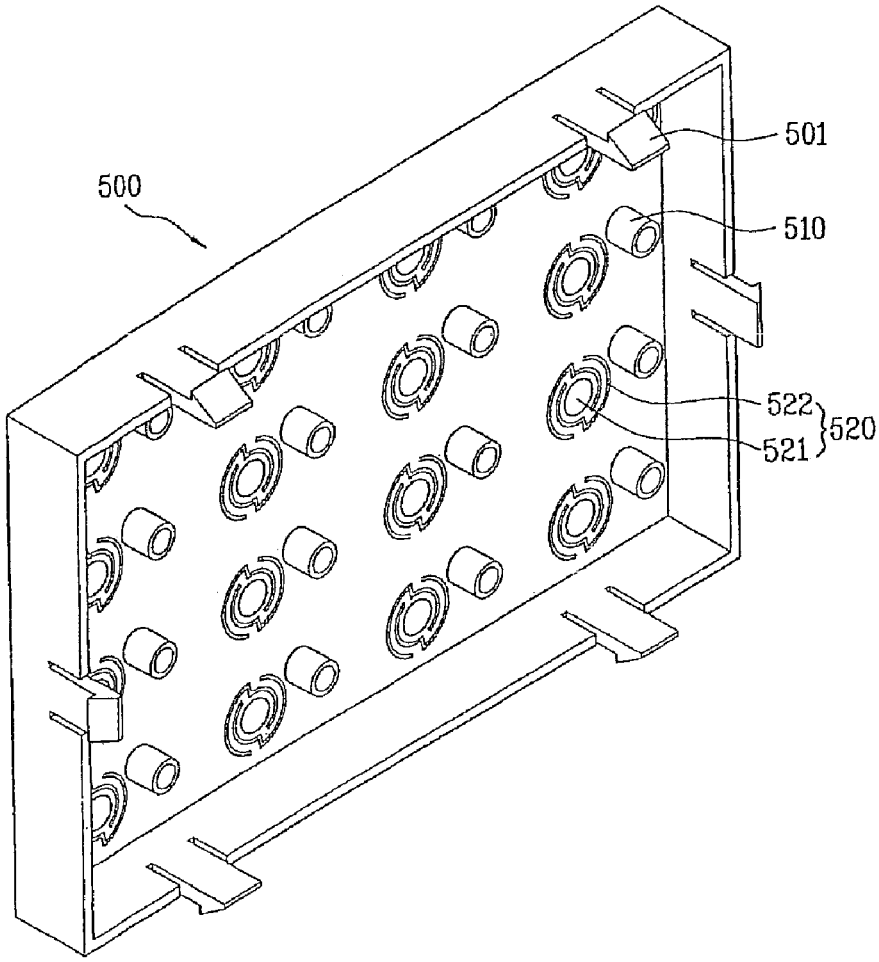

[Fig. 11]
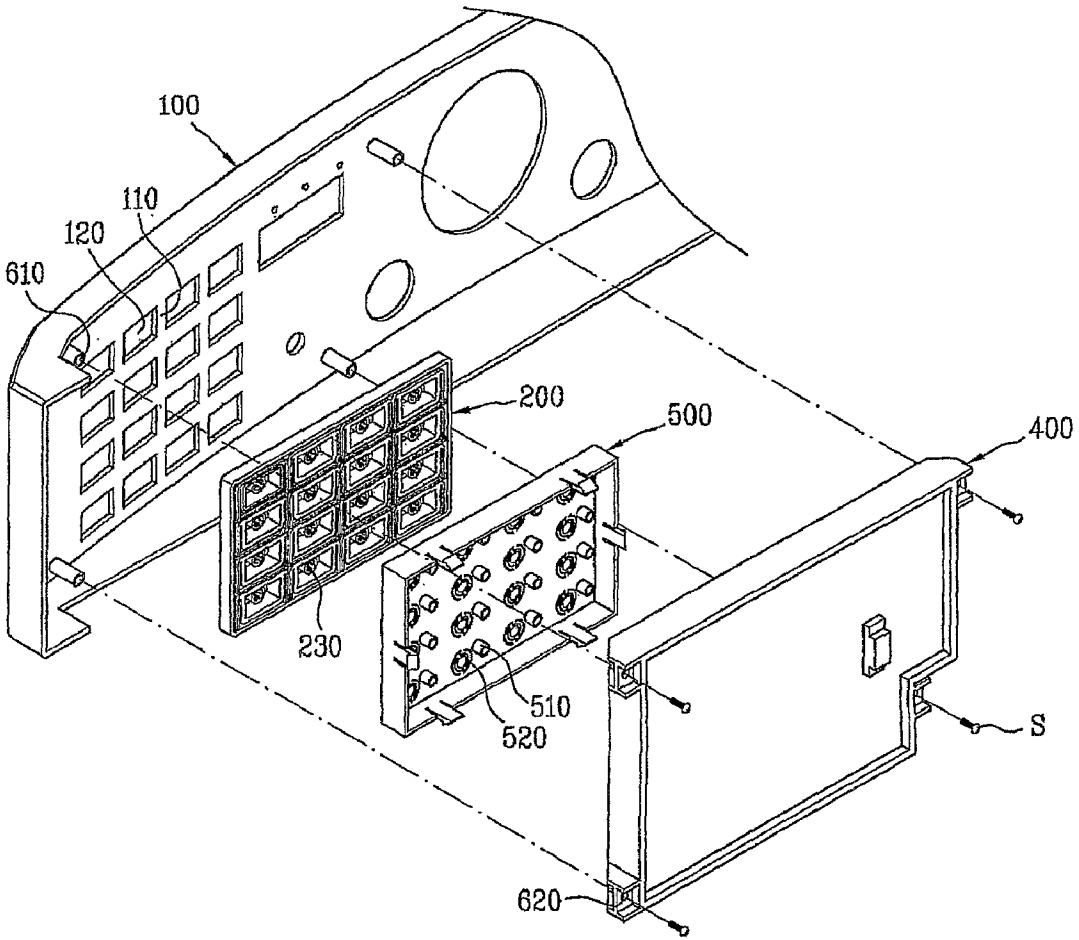

[Fig. 12]
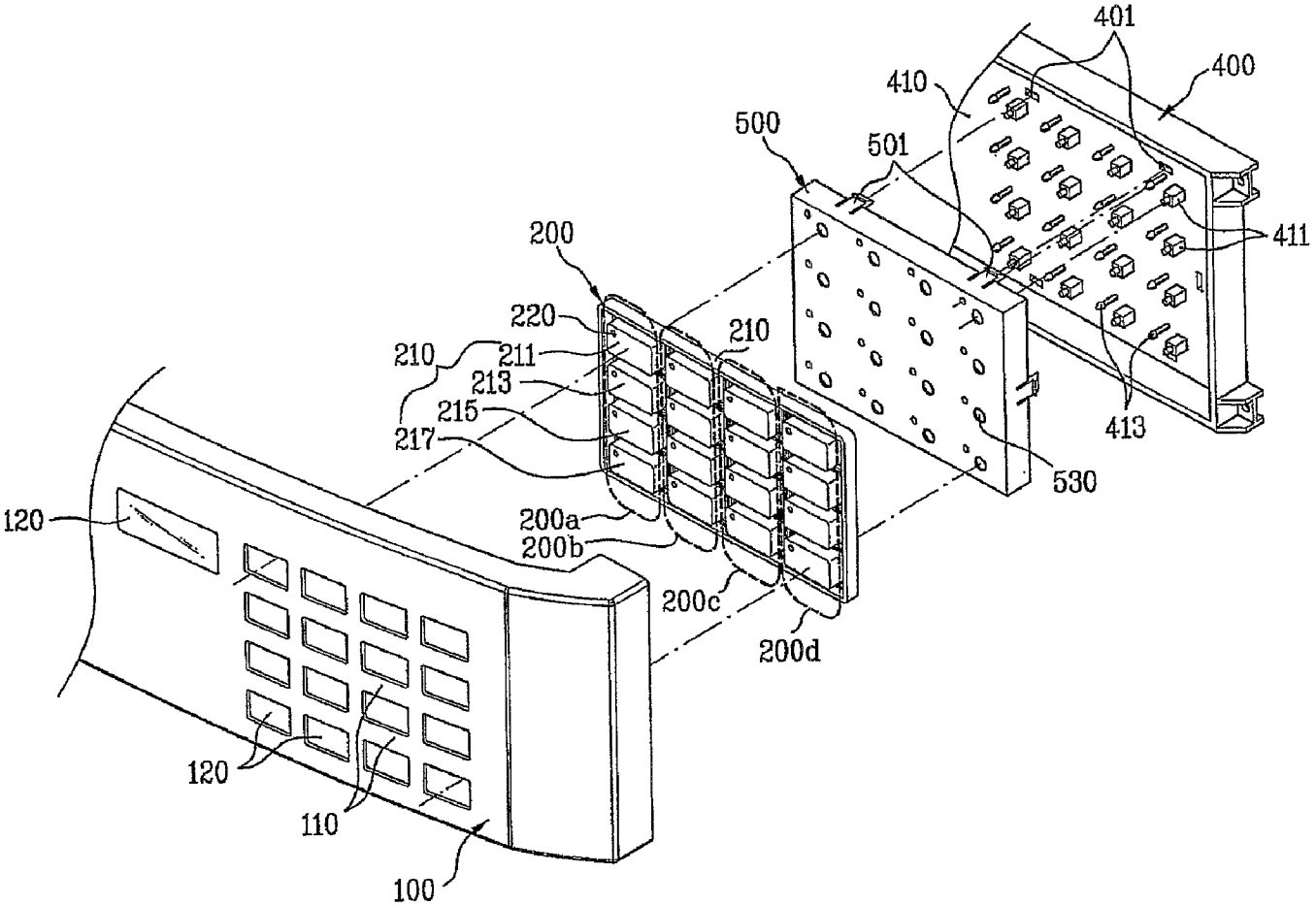

[Fig. 13]
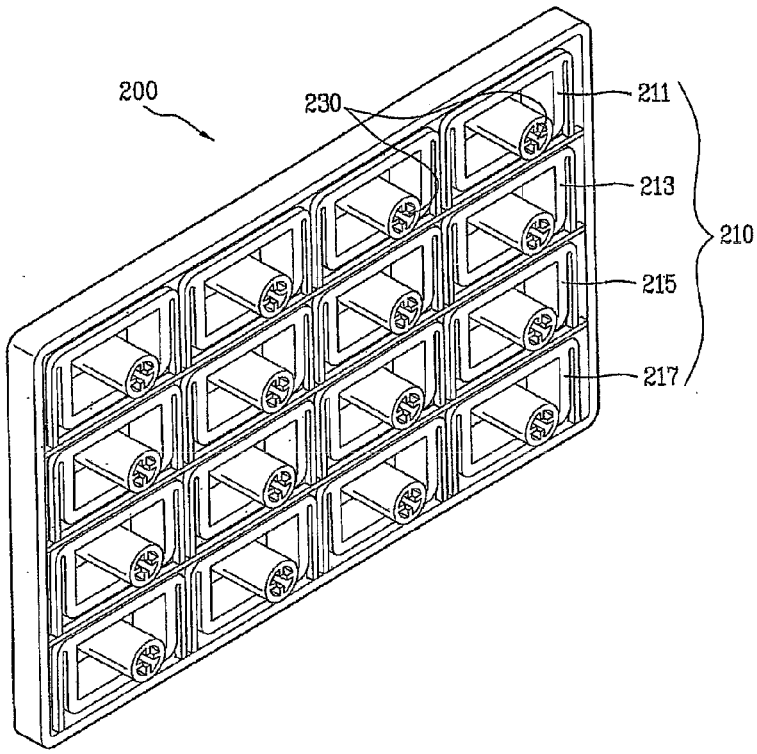
[Fig. 14]
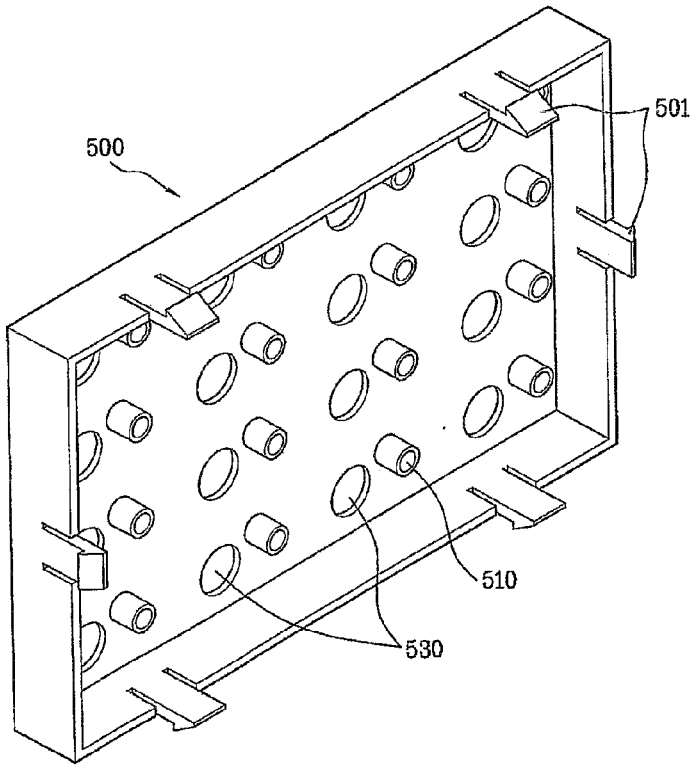

[Fig. 15]
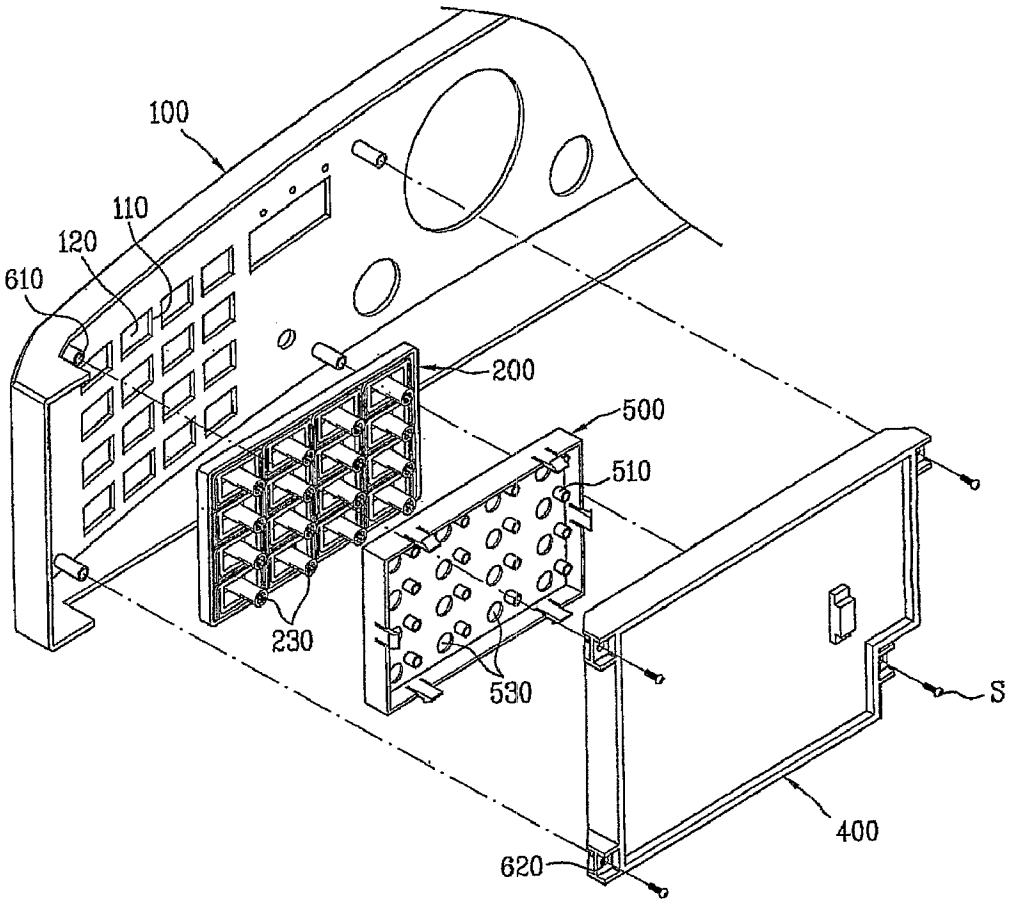

CONTROL PANEL ASSEMBLY FOR LAUNDRY DEVICE

TECHNICAL FIELD

The present invention relates to a control panel assembly of a laundry device, and more particularly, to a button assembly. Although the present invention is suitable for a wide scope of applications, it is particularly suitable for facilitating to manufacture and manipulate the assembly.

BACKGROUND ART

Generally, a laundry device is the general term for a washing machine for washing and dewatering cycles, a dryer for a drying cycle, and a dryer washer for washing and drying cycles.

The dryer is configured to evaporate water from an object to be dried in a manner of heating air using a heating means and then blowing the heated air into a drum.

Normally, a laundry is transferred to a laundry-drying frame for a natural drying. Yet, in case of the rainy season or irregular weather, the natural drying of the laundry is delayed to cause inconvenience for modern living.

So, the demand for a device capable of a natural drying of laundry regardless of weather rises to develop a dryer. The dryer becomes more popularized nowadays to be suitable for the busy modern living.

A dryer according to a related art is explained with reference to FIG. 1 and FIG. 2 as follows.

FIG. 1 is a perspective diagram of a dryer according to a related art and FIG. 2 is a front diagram of a control panel of a dryer according to a related art.

Referring to FIG. 1, a dryer according to a related art consists of a body case 1 and a control panel 2 provided to an upper part of a front side of the body case 1 to manipulate an operation of the dryer.

Referring to FIG. 2, the control panel 2 is provided with a plurality of buttons selected according to an operational condition, an LED window 22 displaying the operational condition, and an LED lamp (not shown in the drawing) provided in rear of the LED window 22.

A plurality of the buttons include higher buttons 23*a* for selecting higher items such as dryness, drying temperature, drying time and the like, a power button 21*b* for turning on/off a power of the dryer, and a pause button 21*c* for stopping an operation of the dryer temporarily.

And, a plurality of the buttons include a plurality of lower buttons 23*b* indicating a time value, a temperature value to indicate an extent of the higher item and are dependent on the corresponding higher buttons 23*a*. And, a plurality of the lower buttons 23*b* are configured to be activated after the corresponding higher button 23*a* has been activated.

DISCLOSURE OF INVENTION

Technical Problem

However, the above-configured buttons of the related art have the following problems.

First of all, after the higher button 23*a* of a higher item has been selected, the respective buttons 23*a* and 23*b* need to be pressed several times to select the lower button 23*b* of the lower item. So, it is inconvenient and troublesome to manipulate each of the buttons.

Secondly, if a wrong button 23*a* or 23*b* is pressed to select an operational condition, the respective buttons 23*a* and 23*b* should be manipulated all over again after original positions of the operational condition has been recovered by pressing the respective buttons 23*a* and 23*b* several times to select an operational condition to be executed.

Accordingly, the present invention is directed to a control panel assembly of a laundry device that substantially obviates one or more of the problems due to limitations and disadvantages of the related art.

An object of the present invention is to provide a control panel assembly of a laundry device, by which a manipulation of buttons is facilitated by improving button configurations of the laundry device.

Another object of the present invention is to provide a control panel assembly of a laundry device, by which manipulated buttons are easily recognized.

Technical Solution

To achieve these and other advantages and in accordance with the purpose of the present invention, as embodied and broadly described, a control panel assembly of a laundry device according to the present invention includes a control panel provided to a front side of a body and a keypad provided to the control panel, the keypad having a plurality of button groups enabling a washing to be performed by selecting a plurality of operational conditions once.

Preferably, a plurality of the buttons groups are configured to execute one of a plurality of functions including a dryness, a drying temperature, a drying time and an additional function.

More preferably, each of a plurality of the button groups comprises a plurality of buttons for operational sub-conditions for each of a plurality of the operational conditions. In this case, a plurality of the buttons are evenly spaced apart from each other not to interfere with each other.

And, each of a plurality of the buttons includes a display unit provided next to the corresponding button to confirm an activation of the corresponding button and a pressuring projection projected from a rear side of the corresponding button.

Moreover, the display unit includes a transparent window enabling light to be externally transmitted and the display unit is built in one body of the corresponding button by double injection molding.

Preferably, a plurality of partition ribs are provided to a front side of the control panel to which a plurality of the button groups are attached to maintain gaps between a plurality of the buttons of each of a plurality of the button groups, respectively. And, each of a plurality of the buttons is configured to be exposed from the front side of the control panel.

Preferably, the control panel assembly further includes a board guide provided in rear of the keypad. And, a circuit board detecting an activation of each of a plurality of the buttons is provided within the board guide.

More preferably, the board guide includes a tact switch provided to a position opposing the corresponding button to come into contact with the corresponding button and an LED lamp provided next to the corresponding tact switch to emit light by an activation of the corresponding tact switch. And, the control panel assembly further includes a lamp supporter provided between the keypad and the board guide, wherein an LED guide perforated by the corresponding LED lamp is provided to a surface of the lamp supporter to prevent a diffusion of the light of the LED lamp and wherein a pressurizing part is provided to the lamp supporter to transfer an elastic force of the corresponding button to the corresponding tact switch.

To further achieve these and other advantages and in accordance with the purpose of the present invention, a control panel assembly of a laundry device includes a control panel provided to a front side of a body, a keypad provided to the control panel, the keypad having a plurality of buttons enabling a washing to be performed by selecting a plurality of operational conditions once, a plurality of pressurizing buttons projected from backsides of a plurality of the buttons, respectively, and a broad guide provided in rear of the keypad to install a circuit board therein, the board guide including a plurality of tact switches provided to positions opposing a plurality of the pressurizing buttons to come into contact with, respectively and a plurality of LED lamps emitting lights according to activations of a plurality of the tact switches, respectively.

Preferably, the control panel assembly further includes a plurality of display units provided to a plurality of the buttons of the keypad to confirm activations of a plurality of the buttons, respectively.

More preferably, each of a plurality of the display units includes a transparent window enabling light to be externally transmitted and a plurality of the display units are built in one body of a plurality of the buttons by double injection molding. And, the control panel assembly further includes a plurality of lamp guides projected from backsides of a plurality of the buttons to prevent the lights of a plurality of the LED lamps from diffusing, respectively.

In this case, a plurality of the lamp guides are projected from the backsides of a plurality of the display units toward the board guide, respectively.

Preferably, a plurality of the buttons are built in one body of the keypad and are formed of a same elastic material.

Preferably, a plurality of partition ribs are provided to a front side of the control panel to which a plurality of the buttons are attached to maintain gaps between a plurality of the buttons, respectively and each of a plurality of the buttons is configured to be exposed from the front side of the control panel.

To further achieve these and other advantages and in accordance with the purpose of the present invention, a control panel assembly of a laundry device includes a control panel provided to a front side of a body, a keypad provided to the control panel, the keypad provided with a button group including a plurality of buttons enabling a washing to be performed by selecting a plurality of operational conditions once, a plurality of pressurizing buttons projected from backsides of a plurality of the buttons, respectively, a broad guide provided in rear of the keypad to install a circuit board therein, the board guide including a plurality of tact switches provided to positions opposing a plurality of the pressurizing buttons to come into contact with, respectively and a plurality of LED lamps emitting lights according to activations of a plurality of the tact switches, respectively, and a lamp supporter provided between the keypad and the board guide, the lamp supporter including a plurality of lamp guides on a surface of the lamp supporter to be perforated by a plurality of the LED lamps, respectively and a plurality of perforated holes perforated by a plurality of the pressurizing projections to come into contact with a plurality of the tact switches, respectively.

Preferably, the control panel assembly further includes a plurality of display units provided to a plurality of the buttons of the keypad to confirm activations of a plurality of the buttons, respectively.

More preferably, each of a plurality of the display units comprises a transparent window enabling light to be externally transmitted and a plurality of the display units are built in one body of a plurality of the buttons by double injection molding.

Preferably, a plurality of the buttons are built in one body of the keypad and are formed of a same elastic material.

More preferably, a plurality of the lamp guides are projected from a backside of the lamp supporter toward the board guide to enclose circumferences of a plurality of the LED lamps, respectively.

More preferably, a plurality of partition ribs are provided to a front side of the control panel to which a plurality of the buttons are attached to maintain gaps between a plurality of the buttons, respectively and each of a plurality of the buttons is configured to be exposed from the front side of the control panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a perspective diagram of a dryer according to a related art;

FIG. 2 is a front diagram of a control panel of a dryer according to a related art;

FIG. 3 is a perspective diagram of a dryer according to an embodiment of the present invention;

FIG. 4 is a front diagram of a control panel according to an embodiment of the present invention, in which an installed configuration of a button group is schematically shown;

FIG. 5 is an exploded perspective diagram of a control panel assembly according to an embodiment of the present invention;

FIG. 6 is a perspective diagram of a keypad according to an embodiment of the present invention, in which a backside of the keypad is shown;

FIG. 7 is an exploded perspective diagram of a control panel assembly according to an embodiment of the present invention, in which a backside of the control panel assembly is shown;

FIG. 8 is an exploded perspective diagram of a control panel assembly according to an embodiment of the present invention;

FIG. 9 is a perspective diagram of a keypad according to an embodiment of the present invention, in which a backside of the keypad is shown;

FIG. 10 is a perspective diagram of a lamp supporter according to an embodiment of the present invention, in which a backside of the lamp supporter is shown;

FIG. 11 is an exploded perspective diagram of a control panel assembly according to an embodiment of the present invention, in which a backside of the control panel assembly is shown;

FIG. 12 is an exploded perspective diagram of a control panel assembly according to an embodiment of the present invention;

FIG. 13 is a perspective diagram of a keypad according to an embodiment of the present invention, in which a backside of the keypad is shown;

FIG. 14 is a perspective diagram of a lamp supporter according to an embodiment of the present invention, in which a backside of the lamp supporter is shown; and FIG. 15 is an exploded perspective diagram of a control panel assembly according to an embodiment of the present invention, in which a backside of the control panel assembly is shown.

BEST MODE FOR CARRYING OUT THE INVENTION

Reference will now be made in detail to the preferred embodiments of the present invention, examples of which are illustrated in the accompanying drawings.

A control panel assembly of a laundry device (hereinafter named 'dryer') according to a first embodiment of the present invention is explained with reference to FIGS. 3 to 8 as follows.

FIG. 3 is a perspective diagram of a dryer according to an embodiment of the present invention, FIG. 4 is a front diagram of a control panel according to an embodiment of the present invention, in which an installed configuration of a button group is schematically shown, FIG. 5 is an exploded perspective diagram of a control panel assembly according to an embodiment of the present invention, FIG. 6 is a perspective diagram of a keypad according to an embodiment of the present invention, in which a backside of the keypad is shown, FIG. 7 is an exploded perspective diagram of a control panel assembly according to an embodiment of the present invention, in which a backside of the control panel assembly is shown, and FIG. 8 is an exploded perspective diagram of a control panel assembly according to an embodiment of the present invention.

Referring to FIGS. 3 to 5, a control panel assembly of a laundry device according to a first embodiment of the present invention includes a control panel 100 provided to a front side of a body 1, a keypad 200 provided to a front side of the control panel 100, and a board guide 400 provided in rear of the keypad 200.

The keypad 400, as shown in FIG. 4, is configured to have a plurality of button groups 200*a*, 200*b*, 200*c* and 200*d* to enable a washing to be performed by selecting a plurality of operational conditions once.

Each of a plurality of the button groups 200*a*, 200*b*, 200*c* and 200*d* is provided to enable one of functions including a dryness, a drying temperature, a drying time and an additional function to be executed by a single action.

In this case, each of a plurality of the button groups 200*a*, 200*b*, 200*c* and 200*d* can include a plurality of buttons 210 for operational sub-conditions corresponding to each of the operational conditions.

For instance, if the dryness is selected from the operational conditions, sub-functions of 'very dry', 'more dry', 'normal dry', 'less dry' and the like are assigned to first to fourth buttons 211, 213, 215 and 217, respectively to execute a drying in a manner that a user selects a specific operational condition once. Meanwhile, it is apparent to those skilled in the art that a plurality of the button groups 200*a*, 200*b*, 200*c* and 200*d* can be further subdivided.

Preferably, a plurality of the buttons 210 are configured to be evenly spaced apart from each other.

The keypad 200, as shown in FIG. 5 and FIG. 6, includes a display unit 220 provided to one side of each of the buttons 210 to enable a user to confirm an operational condition selected by the corresponding button 210 in a manner of transmitting light and a pressurizing projection 230 projected from a rear side of each of the buttons 210 to be moved by interoperating with a push action of each of the buttons 210.

In this case, the display unit 220 preferably includes a transparent window enabling light to be externally transmitted. Preferably, the first embodiment of the present invention proposes that the display unit 220 and the button 210 are formed in one body by double injection molding.

A character unit 130 can be further provided to the front side of the control panel 100 to identify the functions assigned to a plurality of the button groups 200*a*, 200*b*, 200*c* and 200*d*. And, an LED lamp window 170 can be further provided to the front side of the control panel 100.

In particular, the character unit 130 displays characters corresponding to the functions to facilitate a user to identify the functions assigned to a plurality of the button groups 200*a*, 200*b*, 200*c* and 200*d*, respectively.

Meanwhile, a plurality of partition ribs 110 are provided to the front side of the control panel 100, to which a plurality of the button groups 200*a*, 200*b*, 200*c* and 200*d* are attached, to maintain gaps between a plurality of the buttons 210, respectively. And, a plurality of exposing holes 120 are provided between a plurality of the partition ribs 110. If a plurality of the buttons 210 are inserted in a plurality of the exposing holes 120 to be fixed thereto, a plurality of the buttons 210 are installed to be exposed on the front side of the control panel 110.

In this case, a plurality of the partition ribs 110 also play a role in preventing a prescribed button next to a selected button from being pressed together with the selected button.

The board guide 400 is provided in rear of the keypad 200. And, a circuit board 410 is provided within the board guide 400 to detect an activation of each of a plurality of the buttons 210.

In this case, the board guide 400 is provided with a tact switch 411 provided to a position corresponding to each of a plurality of the buttons 210 to come into contact with the corresponding button 210 and an LED lamp 413 provided next to the tact switch 411 to emit light according to an activation of the corresponding tact switch 411.

Meanwhile, a lamp guide 250, as shown in FIG. 6, can be further provided in rear of each of a plurality of the buttons 210 to prevent diffusion of light of the corresponding LED lamp 413.

In this case, it is preferable that the lamp guide 250 is projected from a backside of the display unit 220 toward the board guide 400.

Preferably, each of the pressurizing projections 230 has a length enough to come into contact with the corresponding tact switch 411 in case of being moved by a pressurizing force of the corresponding button 210.

A plurality of locking bosses 610, as shown in FIG. 7, are preferably provided to the backside of the control panel 100 to assemble the board guide 400 to the control panel 100. And, a plurality of locking holes 620 are preferably provided to edges off the board guide 400 to correspond to a plurality of the locking bosses 610, respectively. In this case, the control panel 100 and the board guide 400 are mutually assembled together by separate locking members of screws S.

A process for assembling the respective elements of the above-configured control panel assembly is explained with reference to FIGS. 5 to 7 as follows.

First of all, the buttons 210 provided to the keypad 200 are inserted in the installation holes 120 provided to the partition ribs 521 of the control panel 100 to be fixed thereto, respectively, thereby being externally exposed.

Subsequently, the board guide 400 is installed in rear of the keypad 200. In this case, the board guide 400 is assembled to the control panel 100.

In particular, the LED lamps 413 provided to the board guide 400 are installed in a manner of being inserted in the lamp guides 250, respectively, the pressurizing projections 230 and the tact switches 411 are aligned with each other, the locking holes 620 provided to the board guide 400 is aligned with the locking bosses 610 provided to the control panel 100, and the board guide 400 and the control panel 100 are then assembled together by the screws.

If so, the LED lamps 413 are placed below the transparent windows of the display unit 220 provided to the buttons 210, respectively.

Thus, the control panel assembly is completed by the above-explained process.

An operation process for the above-configured control panel assembly is explained as follows.

First of all, if a user presses a button suitable for an operational condition, the pressurizing projection 230 under the pressed button 210 is moved to come into contact with the corresponding tact switch 411.

Subsequently, the tact switch 411 pressed by the pressurizing projection 230 turns on the LED lam 413 provided next to the corresponding tact switch 411 and transfers a corresponding signal to a microcomputer (not shown in the drawings) to execute the operational condition assigned to the pressed button 210.

In this case, the light of the LED lamp 413 is externally emitted via the transparent window provided to the pressed button 210 to enable the user to recognize whether the button was correctly pressed.

As mentioned in the above description, unlike the related art control panel assembly, the control panel assembly of the laundry device according to the first embodiment of the present invention provides a user with convenience and facilitation in a manner of executing a specific operational condition by pressing one of a plurality of the buttons.

A control panel assembly of a laundry device (hereinafter 'dryer') according to a second embodiment of the present invention is explained with reference to FIG. 3, FIG. 4, and FIGS. 8 to 11 as follows.

Referring to FIG. 3, FIG. 4 and FIG. 8, a control panel assembly of a laundry device according to a second embodiment of the present invention includes a control panel 100 provided to a front side of a body 1 and a keypad 200 provided to a front side of the control panel 100.

The keypad 400, as shown in FIG. 4, is configured to have a plurality of button groups 200*a*, 200*b*, 200*c* and 200*d* to enable a washing to be performed by selecting a plurality of operational conditions once.

Each of a plurality of the button groups 200*a*, 200*b*, 200*c* and 200*d* is provided to enable one of functions including a dryness, a drying temperature, a drying time and an additional function to be executed by a single action.

In this case, each of a plurality of the button groups 200*a*, 200*b*, 200*c* and 200*d* can include a plurality of buttons 210 for operational sub-conditions corresponding to each of the operational conditions.

For instance, if the dryness is selected from the operational conditions, sub-functions of 'very dry', 'more dry', 'normal dry', 'less dry' and the like are assigned to first to fourth buttons 211, 213, 215 and 217, respectively to execute a drying in a manner that a user selects a specific operational condition once. Meanwhile, it is apparent to those stilled in the art that a plurality of the button groups 200*a*, 200*b*, 200*c* and 200*d* can be further subdivided.

Preferably, a plurality of the buttons 210 are configured to be evenly spaced apart from each other.

Meanwhile, the keypad 200 includes a display unit 220 provided to one side of each of the buttons 210 to enable a user to confirm an operational condition selected by the corresponding button 210 in a manner of transmitting light and a pressurizing projection 230 projected from a rear side of each of the buttons 210 to be moved by interoperating with a push action of each of the buttons 210.

In this case, the display unit 220 preferably includes a transparent window enabling light to be externally transmitted. Preferably, the second embodiment of the present invention proposes that the display unit 220 and the button 210 are formed in one body by double injection molding.

A character unit 130, as shown in FIG. 4, can be further provided to the front side of the control panel 100 to display the functions assigned to a plurality of the button groups 200*a*, 200*b*, 200*c* and 200*d*. And, an LED lamp window 170, as shown in FIG. 5, can be further provided to a prescribed part of the front side of the control panel 100.

In particular, the character unit 130 displays characters corresponding to the functions to facilitate a user to identify the functions assigned to a plurality of the button groups 200*a*, 200*b*, 200*c* and 200*d*, respectively.

Meanwhile, a plurality of partition ribs 110 are provided to the front side of the control panel 100, to which a plurality of the button groups 200*a*, 200*b*, 200*c* and 200*d* are attached, to maintain gaps between a plurality of the buttons 210, respectively. And, a plurality of installation holes 120 are provided between a plurality of the partition ribs 110. If a plurality of the buttons 210 are inserted in a plurality of the exposing holes 120 to be fixed thereto, respectively, a plurality of the buttons 210 are installed to be exposed on the front side of the control panel 110.

In this case, a plurality of the partition ribs 110 also play a role in preventing a prescribed button next to a selected button from being pressed together with the selected button.

The control panel assembly according to the second embodiment of the present invention is able to further include a board guide 400 having a circuit board 410. The board guide 400 is provided in rear of the keypad 200. And, the circuit board 410 is provided within the board guide 400 to detect an activation of each of a plurality of the buttons 210.

In this case, the board guide 400 is provided with a tact switch 411 provided to a position corresponding to each of a plurality of the buttons 210 to come into contact with the corresponding button 210 and an LED lamp 413 provided next to the tact switch 411 to emit light according to an activation of the corresponding tact switch 411.

The control panel assembly according to the second embodiment of the present invention can further include a lamp supporter 500, as shown in FIG. 8 and FIG. 10, provided between the keypad 200 and the board guide 400. The lamp supporter 500 includes an LED guide 510 on its surface to be penetrated by the corresponding LED lamp 413 to prevent effusion of light of the LED lamp 413 and a pressurizing part 530 transferring an elastic force of the corresponding button 210 to the corresponding tact switch 411.

In this case, the pressurizing part 520 includes a rib 521 projected from a position opposing the aforesaid pressurizing projection 230 to transfer a push force of the pressurizing projection 230 and a cutting portion 522 provided to a circumference of the corresponding rib 521 to provide an elastic force to the corresponding rib 521.

In particular, the cutting portion 522 is formed by cutting a portion of the circumference of the rib 521. The cutting portion 522 enables the rib 521 to be pressurized to come into contact with the tact switch 411 and plays a role in making the rib 521 return to its original position if the force applied to the rib 521 is released.

Preferably, in order to assemble the lamp supporter 500 to the board guide 400, a plurality of hooks 501 are provided to the lamp supporter 500 and a plurality of hook recesses 401 corresponding to a plurality of the hooks 501 are provided to the board guide 400. Preferably, a plurality of perforated holes 620 are provided to the edges of the board guide 400 opposing the locking bosses 610. In this case, the control panel 100 and the board guide 400 are mutually assembled together by separate locking members of screws S.

A process for assembling the respective elements of the above-configured control panel assembly is explained with reference to FIG. 8 and FIG. 10 as follows.

First of all, the buttons 210 provided to the keypad 200 are inserted in the installation holes 120 provided to the partition ribs 521 of the control panel 100 to be fixed thereto, respectively, thereby being externally exposed. In this case, each of the buttons 210 is inserted in the corresponding installation hole 110 of the control panel 100 to be fixed to an inside of the control panel 100.

Subsequently, the lamp supporter 500 is installed in rear of the keypad 200. In particular, the lamp supporter 500 is preferentially attached to the board guide 400. In this case, the lamp supporter 500 and the board guide 400 are assembled by fitting the hooks 510 provided to the lamp supporter 50 to the hook recesses 401 provided to the board guide 400, respectively.

In this case, the LED lamps 413 provided to the board guide 400 are installed to perforate the LED guides 510 provided to the lamp supporter 500, respectively. And, the ribs 521 are installed to be aligned with the tact switches 411, respectively.

Subsequently, the board guide 400 having the lamp supporter 500 assembled thereto is installed in rear of the keypad 200. In this, the board guide 400 is assembled to the control panel 100.

In particular, the perforated holes 620 provided to the board guide 400, as shown in FIG. 10, are aligned with the locking bosses 610 provided to the control panel 100, respectively. The control panel 100 and the board guide 400 are then assembled together by the screws S.

If so, the LED lamps 413 perforating the LED guides 510 are placed under the transparent windows of the display unit provided to the buttons 210, respectively.

Thus, the control panel assembly is completed by the above-explained process.

An operation process for the above-configured control panel assembly is explained as follows.

First of all, if a user presses a button 210 suitable for an operational condition, the pressurizing projection 230 under the pressed button 210 is moved to pressurize the corresponding rib 521. The pressurized rib 521 is then moved to come into contact with the corresponding tact switch 411.

Subsequently, the tact switch 411 pressed by the selected button 210 turns on the LED lam 413 provided next to the corresponding tact switch 411 and transfers a corresponding signal to a microcomputer (not shown in the drawings) to execute the operational condition assigned to the pressed button 210.

In this case, the light of the LED lamp 413 is externally emitted via the transparent window provided to the pressed button 210 to enable the user to recognize whether the button was correctly pressed.

As mentioned in the above description, unlike the related art control panel assembly, the control panel assembly of the laundry device according to the second embodiment of the present invention provides a user with convenience and facilitation in a manner of executing a specific operational condition by pressing one of a plurality of the buttons.

A control panel assembly of a laundry device (hereinafter 'dryer') according to a third embodiment of the present invention is explained with reference to FIG. 3, FIG. 4, and FIGS. 12 to 15 as follows.

Referring to FIG. 3, FIG. 4 and FIG. 2, a control panel assembly of a laundry device according to a third embodiment of the present invention includes a control panel 100 provided to a front side of a body 1, a keypad 200 provided to a front side of the control panel 100, a board guide 400 provided in rear of the keypad 200, and a lamp supporter 500 provided between the keypad 200 and the board guide 400.

The keypad 400, as shown in FIG. 4, is configured to have a plurality of button groups 200*a*, 200*b*, 200*c* and 200*d* to enable a washing to be performed by selecting a plurality of operational conditions once.

Each of a plurality of the button groups 200*a*, 200*b*, 200*c* and 200*d* is provided to enable one of functions including a dryness, a drying temperature, a drying time and an additional function to be executed by a single action.

In this case, each of a plurality of the button groups 200*a*, 200*b*, 200*c* and 200*d* can include a plurality of buttons 210 for operational sub-conditions corresponding to each of the operational conditions.

For instance, if the dryness is selected from the operational conditions, sub-functions of 'very dry', 'more dry', 'normal dry', 'less dry' and the like are assigned to first to fourth buttons 211, 213, 215 and 217, respectively to execute a drying in a manner that a user selects a specific operational condition once. Meanwhile, it is apparent to those skilled in the art that a plurality of the button groups 200*a*, 200*b*, 200*c* and 200*d* can be further subdivided.

Preferably, a plurality of the buttons 210 are configured to be evenly spaced apart from each other.

Meanwhile, the keypad 200, as shown in FIG. 12 and FIG. 13, includes a display unit 220 provided to one side of each of the buttons 210 to enable a user to confirm an operational condition selected by the corresponding button 210 in a manner of transmitting light and a pressurizing projection 230 projected from a rear side of each of the buttons 210 to be moved by interoperating with a push action of each of the buttons 210.

In this case, the display unit 220 preferably includes a transparent window enabling light to be externally transmitted. Preferably, the third embodiment of the present invention proposes that the display unit 220 and the button 210 are formed in one body by ruble injection molding.

A character unit 130, as shown in FIG. 4, can be further provided to the front side of the control panel 100 to display the functions assigned to a plurality of the button groups 200*a*, 200*b*, 200*c* and 200*d*. And, an LED lamp window 170, as shown in FIG. 5, can be further provided to a prescribed part of the front side of the control panel 100.

In particular, the character unit 130 displays characters corresponding to the functions to facilitate a user to identify the functions assigned to a plurality of the button groups 200*a*, 200*b*, 200*c* and 200*d*, respectively.

Meanwhile, a plurality of partition ribs 110 are provided to the front side of the control panel 100, to which a plurality of the button groups 200*a*, 200*b*, 200*c* and 200*d* are attached, to maintain gaps between a plurality of the buttons 210, respectively. And, a plurality of installation holes 120 are provided between a plurality of the partition ribs 110. If a plurality of the buttons 210 are inserted in a plurality of the exposing holes 120 to be fixed thereto, respectively, a plurality of the buttons 210 are installed to be exposed on the front side of the control panel 110.

In this case, a plurality of the partition ribs 110 also play a role in preventing a prescribed button next to a selected button from being pressed together with the selected button.

The board guide 400 is provided in rear of the keypad 200 and a circuit board 410 detecting an activation of each o the buttons 210 is provided within the board guide 400.

In this case, the board guide 400 is provided with a tact switch 411 provided to a position corresponding to each of a plurality of the buttons 210 to come into contact with the corresponding button 210 and an LED lamp 413 provided next to the tact switch 411 to emit light according to an activation of the corresponding tact switch 411.

And, the lamp supporter 500 is provided between the keypad 200 and the board guide 400.

The lamp supporter 500, as shown in FIG. 12 and FIG. 14, includes a plurality of lamp guides 510 on its surface to be projected from the backside of the lamp supporter 500 toward the board guide 400. And, a plurality of perforated holes 530 are provided to the surface of the lamp supporter 500. So, the pressurizing projections 230 perforate the perforated holes 530 and then come into contact with the tact switches 411, respectively.

In this case, the lamp guides 510 are installed to enclose circumferences of the LED lamps 413 to prevent lights of the LED lamps 413 from diffusing, respectively.

In this case, each of the pressurizing projections 230 has a length enough to contact with the corresponding tact switch 411 if the corresponding pressurizing projection 230 is moved by receiving a pressurizing force of the corresponding button 210.

Preferably, in order to assemble the lamp supporter 500 to the board guide 400, a plurality of hooks 501 are provided to the lamp supporter 500 and a plurality of hook recesses 401 corresponding to a plurality of the hooks 501 are provided to the board guide 400. In this case, each of the hooks 501 is fitted into the corresponding hook recess 401 to assemble the lamp supporter 500 and the board guide 400 together.

Preferably, a plurality of locking bosses 610 are provided to the backside of the control panel 100 and a plurality of locking holes 620 are provided to the edges of the board guide 400 opposing the locking bosses 610, respectively. In this case, the control panel 100 and the board guide 400 are mutually assembled together by separate locking members of screws S.

A process for assembling the respective elements of the above-configured control panel assembly is explained with reference to FIG. 12 and FIG. 15 as follows.

First of all, the buttons 210 provided to the keypad 200 are inserted in the installation holes 120 provided to the partition ribs 521 of the control panel 100 to be fixed thereto, respectively, thereby being externally exposed.

In this case, each of the buttons 210 is inserted in the corresponding installation hole 110 of the control panel 100 to be fixed to an inside of the control panel 100.

Subsequently, the lamp supporter 500 is installed in rear of the keypad 200. In particular, the lamp supporter 500 is preferentially attached to the board guide 400.

In this case, the lamp supporter 500 and the board guide 400, as shown in FIG. 12, are assembled together by fitting the hooks 510 provided to the lamp supporter 500 to the hook recesses 401 provided to the board guide 400, respectively.

In this case, the LED lamps 413 provided to the board guide 400 are installed to perforate the LED guides 510 provided to the lamp supporter 500, respectively. And, the ribs 521 of the lamp supporter 500 are installed to be aligned with the tact switches 411, respectively.

Subsequently, the board guide 400 having the lamp supporter 500 assembled thereto is installed in rear of the keypad 200. In this, the board guide 400 is assembled to the control panel 100.

In particular, after the pressurizing projections 230 provided to the keypad 200 have been installed toward the perforated holes 530 of the lamp supporter 500, the locking holes 620 provided to the board guide 400, as shown in FIG. 8, are aligned with the locking bosses 610 provided to the control panel 100, respectively. The control panel 100 and the board guide 400 are then assembled together by the screws S.

If so, the LED lamps 413 perforating the lamp guides 530 are placed under the transparent windows of the display unit 200 provided to the buttons 210, respectively.

Thus, the control panel assembly is completed by the above-explained process.

An operation process for the above-configured control panel assembly according to the third embodiment of the present invention is explained as follows.

First of all, if a user presses a button 210 suitable for an operational condition, the pressurizing projection 230 under the pressed button 210 passes through the corresponding perforated hole 530 to come into contact with the corresponding tact switch 411.

Subsequently, the tact switch 411 pressed by the selected button 210 turns on the LED lam 413 provided next to the corresponding tact switch 411 and transfers a corresponding signal to a microcomputer (not shown in the drawings) to execute the operational condition assigned to the pressed button 210.

In this case, the light of the LED lamp 413 is externally emitted via the transparent window provided to the pressed button 210 to enable the user to recognize whether the button was correctly pressed.

As mentioned in the above description, unlike the related art control panel assembly, the control panel assembly of the laundry device according to the third embodiment of the present invention provides a user with convenience and facilitation in a manner of executing a specific operational condition by pressing one of a plurality of the buttons.

In the aforesaid embodiments of the present invention, the dryer is taken as an example for the laundry device. And, it is apparent that the present invention is applicable to other laundry devices having the configurations similar to that of the dryer such as a washing machine, a washer and dryer, and the like.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

Accordingly, the present invention provides the following effects or advantages.

First of all, a button configuration of the present invention enables a user to execute an operation by selecting a button corresponding to an operational condition once, whereby a user is provided with convenience for an operational selection to enhance reliability of product.

Secondly, by configuring a plurality of buttons in one body of a keypad, each of the buttons is facilitated to be detachably attached to a control panel.

Thirdly, by reducing the number of elements for the configuration of a control panel assembly, an assembling process and time are reduced for the const reduction.

The invention claimed is:

1. A control panel assembly of a laundry device, comprising:

a control panel provided to a front side of a body; and a keypad provided to the control panel, the keypad having a plurality of button groups enabling a washing to be performed by selecting a plurality of operational conditions once;

a board guide provided in rear of the keypad wherein a circuit board detecting an activation of each of a plurality of the buttons is provided within the board guide; and a lamp supporter provided between the keypad and the board guide, wherein an LED guide perforated by the corresponding LED lamp is provided to a surface of the lamp supporter to prevent a diffusion of the light of the LED lamp and wherein a pressurizing part is provided to the lamp supporter to transfer an elastic force of the corresponding button to the corresponding tact switch.

2. The control panel assembly of claim 1, wherein a plurality of partition ribs are provided to a front side of the control panel to which a plurality of the button groups are attached to maintain gaps between a plurality of the buttons of each of a plurality of the button groups, respectively and wherein each of a plurality of the buttons is configured to be exposed from the front side of the control panel.

3. The control panel assembly of claim 1, the board guide comprising: a tact switch provided to a position opposing the corresponding button to come into contact with the corresponding button; and an LED lamp provided next to the corresponding tact switch to emit light by an activation of the corresponding tact switch.

4. The control panel assembly of claim 1, wherein a plurality of the buttons groups are configured to execute one of a plurality of functions including a dryness, a drying temperature, a drying time and an additional function.

5. The control panel assembly of claim 4, wherein each of a plurality of the button groups comprises a plurality of buttons for operational sub-conditions for each of a plurality of the operational conditions.

6. The control panel assembly of claim 5, wherein a plurality of the buttons are evenly spaced apart from each other not to interfere with each other.

7. The control panel assembly of claim 6, each of a plurality of the buttons, comprising:

a display unit provided next to the corresponding button to confirm an activation of the corresponding button; and a pressuring projection projected from a rear side of the corresponding button.

8. The control panel assembly of claim 7, wherein the display unit comprises a transparent window enabling light to be externally transmitted and wherein the display unit is built in one body of the corresponding button by ruble injection molding.

9. A control panel assembly of a laundry device, comprising:

a control panel provided to a front side of a body;

a keypad provided to the control panel, the keypad having a plurality of buttons enabling a washing to be performed by selecting a plurality of operational conditions once;

a plurality of pressurizing projections projected from backsides of a plurality of the buttons, respectively;

a board guide provided in rear of the keypad to install a circuit board therein, the board guide comprising:

a plurality of tact switches provided to positions opposing a plurality of the pressurizing buttons to come into contact with, respectively; and a plurality of LED lamps emitting lights according to activations of a plurality of the tact switches, respectively; and a plurality of lamp guides projected from backsides of a plurality of the buttons toward the board guide to prevent the lights of a plurality of the LED lamps from diffusing, respectively.

10. The control panel assembly of claim 9, wherein a plurality of the buttons are built in one body of the keypad and are formed of a same elastic material.

11. The control panel assembly of claim 9, wherein a plurality of partition ribs are provided to a front side of the control panel to which a plurality of the buttons are attached to maintain gaps between a plurality of the buttons, respectively and wherein each of a plurality of the buttons is configured to be exposed from the front side of the control panel.

12. The control panel assembly of claim 9, further comprising a plurality of display units provided to a plurality of the buttons of the keypad to confirm activations of a plurality of the buttons, respectively.

13. The control panel assembly of claim 12, wherein each of a plurality of the display units comprises a transparent window enabling light to be externally transmitted and wherein a plurality of the display units are built in one body of a plurality of the buttons by double injection molding.

14. The control panel assembly of claim 13, wherein a plurality of the lamp guides are projected from the backsides of a plurality of the display units toward the board guide, respectively.

15. A control panel assembly of a laundry device, comprising:

a control panel provided to a front side of a body;

a keypad provided to the control panel, the keypad provided with a button group including a plurality of buttons enabling a washing to be performed by selecting a plurality of operational conditions once;

a plurality of pressurizing projections projected from backsides of a plurality of the buttons, respectively;

a board guide provided in rear of the keypad to install a circuit board therein, the board guide comprising:

a plurality of tact switches provided to positions opposing a plurality of the pressurizing projections to come into contact with, respectively; and a plurality of LED lamps emitting lights according to activations of a plurality of the tact switches, respectively; and a lamp supporter provided between the keypad and the board guide, the lamp supporter comprising:

a plurality of lamp guides on a surface of the lamp supporter to be perforated by a plurality of the LED lamps, respectively; and a plurality of perforated holes perforated by a plurality of the pressurizing projections to come into contact with a plurality of the tact switches, respectively.

16. The control panel assembly of claim 15, further comprising a plurality of display units provided to a plurality of the buttons of the keypad to confirm activations of a plurality of the buttons, respectively.

17. The control panel assembly of claim 16, wherein each of a plurality of the display units comprises a transparent window enabling light to be externally transmitted and wherein a plurality of the display units are built in one body of a plurality of the buttons by double injection molding.

18. The control panel assembly of claim 15, wherein a plurality of the buttons are built in one body of the keypad and are formed of a same elastic material.

19. The control panel assembly of claim 18, wherein a plurality of the lamp guides are projected from a backside of the lamp supporter toward the board guide to enclose circumferences of a plurality of the LED lamps, respectively.

20. The control panel assembly of claim 18, wherein a plurality of partition ribs are provided to a front side of the control panel to which a plurality of the buttons are attached to maintain gaps between a plurality of the buttons, respectively and wherein each of a plurality of the buttons is configured to be exposed from the front side of the control panel.

* * * * *